US009205647B2

(12) United States Patent
Ichikawa

(10) Patent No.: US 9,205,647 B2
(45) Date of Patent: Dec. 8, 2015

(54) INKJET HEAD

(71) Applicants: KABUSHIKI KAISHA TOSHIBA, Tokyo (JP); TOSHIBA TEC KABUSHIKI KAISHA, Tokyo (JP)

(72) Inventor: Masaya Ichikawa, Kannami Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/477,632

(22) Filed: Sep. 4, 2014

(65) Prior Publication Data

US 2015/0070425 A1 Mar. 12, 2015

(30) Foreign Application Priority Data

Sep. 9, 2013 (JP) ..... 2013-186081

(51) Int. Cl.

*B41J 29/38* (2006.01)
*B41J 2/045* (2006.01)
*B41J 2/05* (2006.01)

(52) U.S. Cl.

CPC ..... *B41J 2/04588* (2013.01); *B41J 2/04581* (2013.01); *B41J 2/04598* (2013.01); *B41J 2/04573* (2013.01)

(58) Field of Classification Search

CPC . B41J 2/04541; B41J 2/04581; B41J 2/04588
See application file for complete search history.

(56) References Cited

U.S. PATENT DOCUMENTS

| | | | | |
|---|---|---|---|---|
| 6,193,343 | B1 | 2/2001 | Norigoe et al. | |
| 6,409,295 | B1 * | 6/2002 | Norigoe | 347/11 |
| 7,857,406 | B2 * | 12/2010 | Komai | 347/11 |
| 2011/0279502 | A1 * | 11/2011 | Kaneko et al. | 347/11 |

FOREIGN PATENT DOCUMENTS

| | | |
|---|---|---|
| JP | 2000-015802 | 1/2000 |
| JP | 2002-019103 | 1/2002 |

* cited by examiner

*Primary Examiner* — Shelby Fidler
*Assistant Examiner* — Tracey McMillion
(74) *Attorney, Agent, or Firm* — Patterson & Sheridan, LLP

(57) ABSTRACT

An inkjet head includes a plurality of pressure chambers, each in communication with an ink supply, a plurality of piezoelectric members configured to deform to vary the volume of the pressure chambers, and drive unit that applies a driving signal to each of the piezoelectric members. The driving signal includes, in order, a first negative voltage over a first period having a predetermined length, a first positive voltage followed by a zero voltage over a second period having the same length, a second positive voltage over a third period having the same length, the zero voltage followed by a second negative voltage over a fourth period having the same length, and the zero voltage over a fifth period having the same length. The predetermined length is a half of an inherent vibration cycle of ink that is within the pressure chamber.

20 Claims, 7 Drawing Sheets

INKJET HEAD

CROSS-REFERENCE TO RELATED APPLICATION

This application is based upon and claims the benefit of priority from Japanese Patent Application No. 2013-186081, filed Sep. 9, 2013, the entire contents of which are incorporated herein by reference.

FIELD

Embodiments described herein relate generally to an inkjet head.

BACKGROUND

An inkjet head for use in an inkjet printer includes a plurality of pressure chambers for accommodating ink, a nozzle plate which is provided on one end of the pressure chambers. A plurality nozzles are provided in the nozzle plate for ejecting ink droplets to the pressure chambers respectively. A plurality of piezoelectric actuators are provided correspondingly to the pressure chambers to give vibration to the pressure chambers respectively through a vibration plate.

In this kind of the inkjet head, when the piezoelectric actuator is driven, vibration is given to the pressure chamber corresponding to the actuator. This pressure vibration changes the volume inside the pressure chamber and an ink droplet is ejected from the nozzle corresponding to the pressure chamber. The ink droplet is applied to a recording medium, such as recording paper and forms a dot on the recording medium. By forming these dots continuously, the inkjet head forms a letter and an image on the recording medium according to image data.

In the inkjet head, it is preferable that ink droplets are ejected stably from the viewpoint of printing accuracy. There is known a first example of a driving waveform in which, with a predetermined cycle (AL) as a unit, voltages −V, 0, and +V are applied to three AL periods.

This method may eject ink droplets stably. This method, however, does not obtain a sufficient ejection amount because a difference in the adjacent voltages is V. A second example of a driving waveform is known in which −V is applied in the first AL period, +V is applied in the next second AL period, and 0 is applied in the next AL period. In this case, a difference between the first AL period and the next second AL period is 2V, and sufficient ink may be ejected.

However, when +V is applied at the second AL period, ink ejection gets unstable.

DETAILED DESCRIPTION

In general, an inkjet head according to one embodiment is capable of ejecting a sufficient amount of ink stably and accurately.

According to one embodiment, there is provided an inkjet head including a plurality of pressure chambers, each in communication with an ink supply, a plurality of piezoelectric members configured to deform to vary the volume of the pressure chambers, and a drive unit that applies a driving signal to each or the piezoelectric members. The driving signal includes, in order, a first negative voltage over a first period having a predetermined length, a first positive voltage followed by a zero voltage over a second period having the same length, a second positive voltage over a third period having the same length, the zero voltage followed by a second negative voltage over a fourth period having the same length, and the zero voltage over a fifth period having the same length. The predetermined length is a half of an inherent vibration cycle of ink that is within the pressure chamber.

Figure 1:
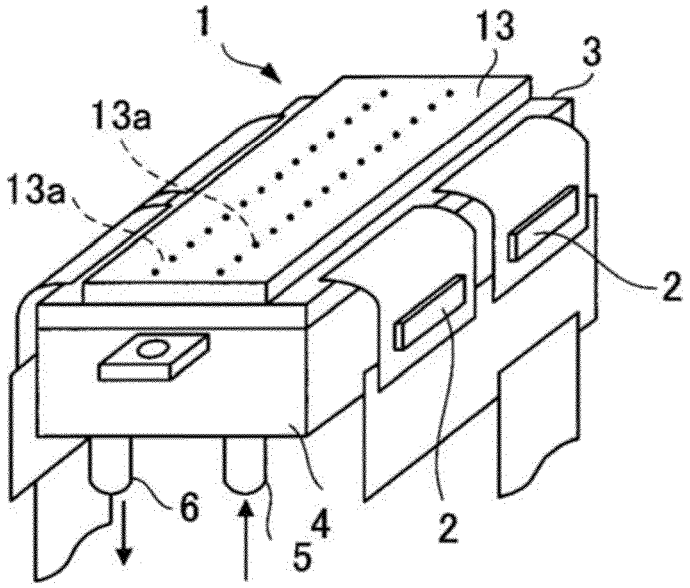
FIG. 1 is a perspective view of an inkjet head according to one embodiment.
Figure 2:
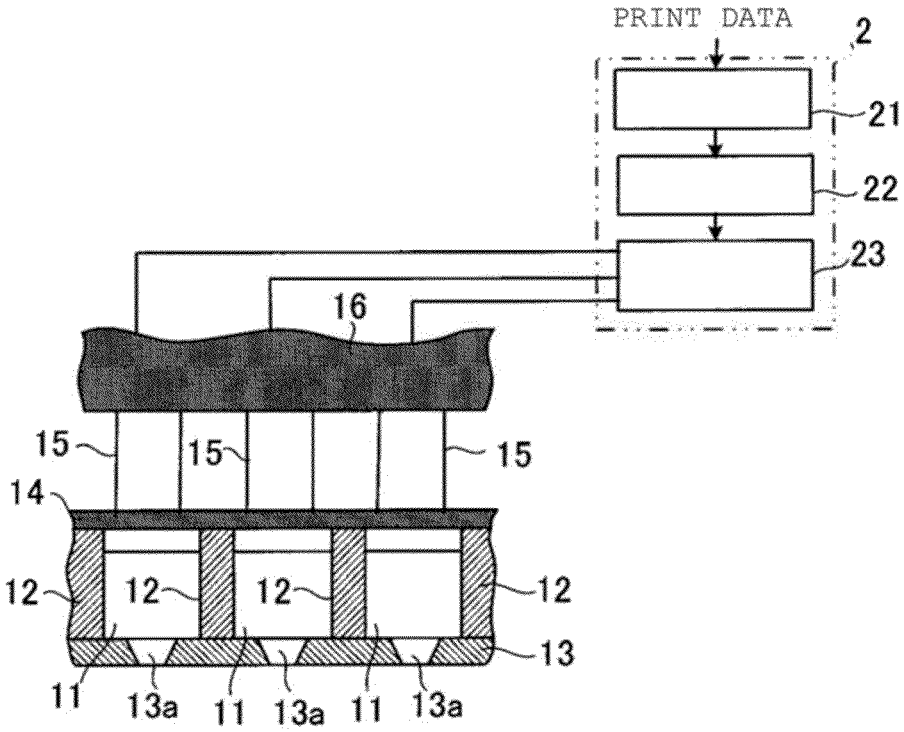
FIG. 2 illustrates a cross-section of a portion of the inkjet head.

Hereinafter, one embodiment will be described with reference to the drawings. FIG. 1 is a perspective view of an inkjet head according to one embodiment and FIG. 2 is a cross-section of a portion of the inkjet head.

An inkjet head 1 includes a driving device 2, a head substrate 3, and a manifold 4. The manifold 4 includes a supply channel 5 and a discharge channel 6 of ink. The inkjet head 1 ejects ink supplied from an ink supplying unit through the supply channel 5, from respective nozzles 13*a*, according to a driving signal from the driving device 2. Of the ink supplied from the supply channel 5 into the manifold 4, the ink not ejected from the nozzles 13*a* is discharged to the ink supplying unit from the discharge channel 6.

The head substrate 3 includes a nozzle plate 13. The nozzle plate 13 includes a plurality of nozzles 13*a* for ejecting ink droplets. The nozzles 13*a* are aligned in rows (two rows in FIG. 1) in the longitudinal direction of the nozzle plate 13.

The head substrate 3 is provided with a plurality of pressure chambers 11 respectively corresponding to the nozzles 13*a*. The respective pressure chambers 11 accommodate ink and are divided by partition walls 12.

The head substrate 3 includes a common pressure chamber 18. Ink is supplied to the common pressure chamber 18 through the supply channel 5. The common pressure chamber 18 communicates with the respective pressure chambers 11. The ink is supplied to the respective pressure chambers 11 and the respective nozzles 13*a* that correspond to each pressure chamber 11. With ink supplied to the pressure chamber 11 and the nozzle 13*a*, a meniscus of ink is formed within each nozzle 13*a*.

In the inkjet head 1 described above, when a driving signal is applied to a piezoelectric member 15 through an electrode 17, the piezoelectric member 15 expands or contracts. According to the expansion or contraction of the piezoelectric member 15, a vibration plate 14 deforms and vibrates the pressure chamber 11. According to this vibration, the volume of the pressure chamber 11 varies and a pressure wave occurs within the pressure chamber 11, and an ink droplet is ejected from the nozzle 13*a*.

Here, the vibration plate 14 and the piezoelectric member 15 form an actuator for vibrating the pressure chamber 11. The inkjet head 1 is provided with the same number of actuators as the number of the nozzles 13*a*.

Next, the driving device 2 will be described. The driving device 2 includes a communication unit 21, a calculation unit 22, and a driving signal generating unit 23. The communication unit 21 receives print data of an image to be printed, for example, from a host computer for controlling the inkjet printer. The calculation unit 22 calculates the number of driving pulses based on the print data.

The driving signal generating unit 23 supplies a driving signal with the number of driving pulses calculated by the calculation unit 22 selectively to the respective actuators. By applying the voltage of the driving signal to the actuator, ink droplets for the number of drops corresponding to the pulse number are ejected from the nozzle 13*a* of the pressure chamber 11 corresponding to the actuator.

Figure 3:
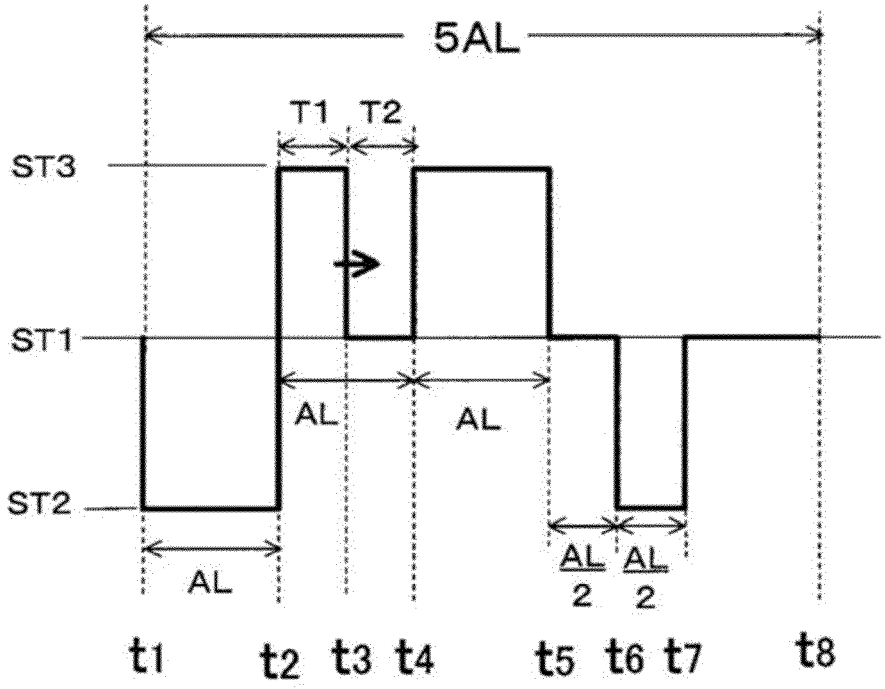
FIG. 3 illustrates an example waveform of a driving signal applied from a driving signal generating unit.

An example of the waveform of the driving signal applied to the adjacent actuators respectively is shown in FIG. 3.

The driving signal has a period of five times AL, and thereafter, it will be repeated. Here, AL is the unit of time of inverting the pressure within the ink chamber from a positive pressure to a negative pressure or vice versa according to the inherent vibration, and a half time of the inherent vibration cycle of ink within the ink chamber.

Figure 4:
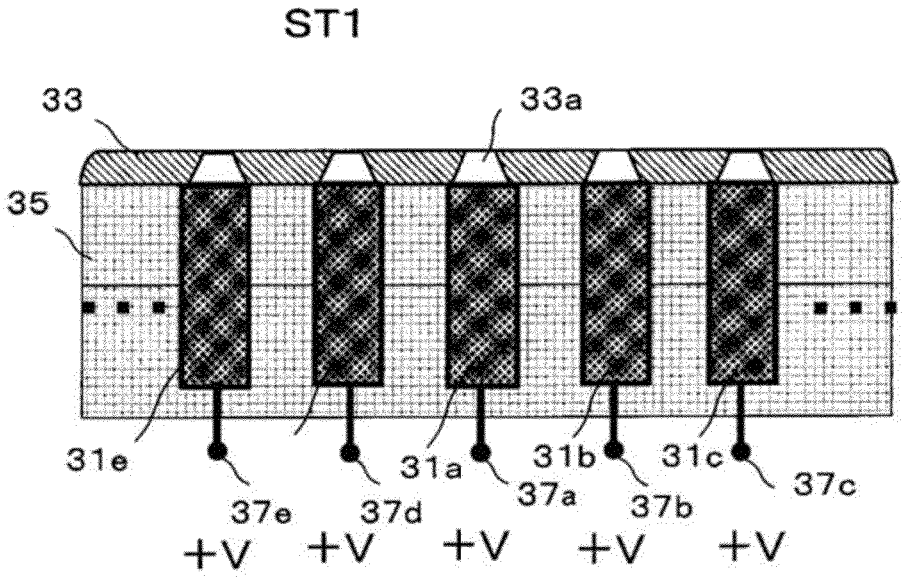
FIG. 4 schematically illustrates voltage applied to electrodes of respective pressure chambers and, in a state ST1.
Figure 5:
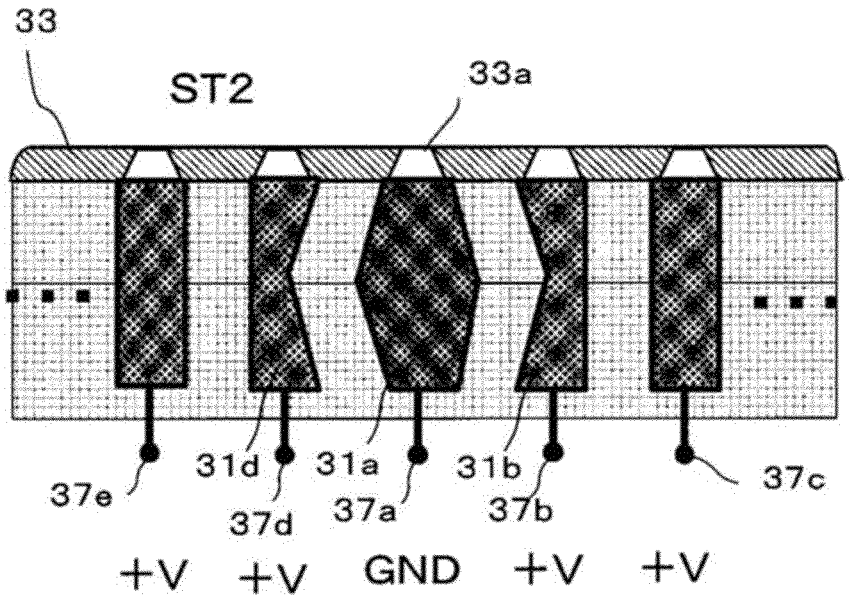
FIG. 5 schematically illustrates voltage applied to the electrodes of the respective pressure chambers, in a state ST2.
Figure 6:
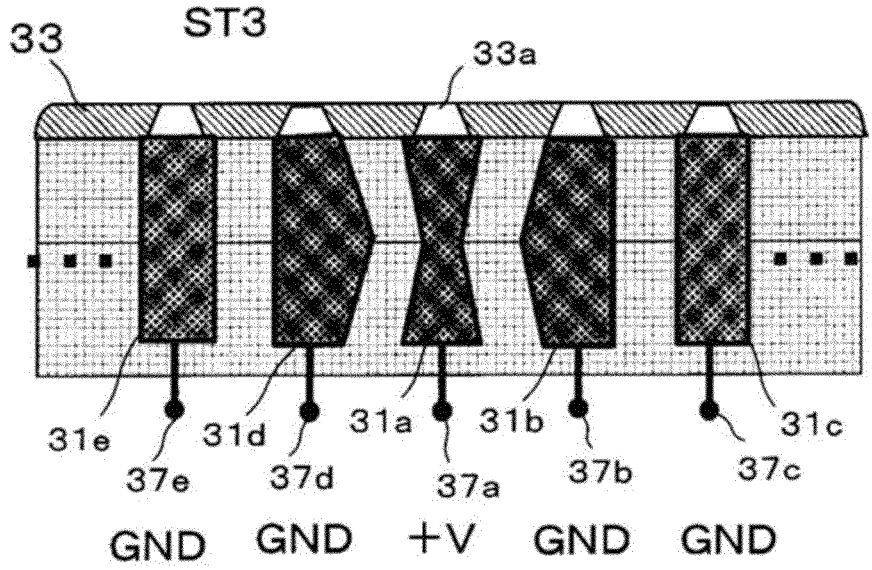
FIG. 6 schematically illustrates voltage applied to the electrodes of the respective pressure chambers, in a state ST3.

The voltage application to the electrodes of the pressure chambers and the state of the pressure chambers in respective states ST1, ST2, and ST3 are schematically shown in FIGS. 4 to 6. These figures are for the sake of easy understanding, and the structural and positional relation may not accurately conform to the embodiment of inkjet head shown in FIGS. 1 and 2.

With respect to FIGS. 4 to 6, description is made regarding the ink ejected from a nozzle 33*a* in a nozzle plate 33.

The nozzle 33*a* is directly connected to a pressure chamber 31*a* provided within a piezoelectric member 35. A terminal 37*a* is connected to the electrode of the pressure chamber. Pressure chambers 31*b*, 31*c*, 31*d*, and 31*e* (having the sane structure) are provided on the both sides of the pressure chamber 31*a*. Terminals 37*b*, 37*c*, 3*d*, and 37*e* are connected to the respective electrodes of these pressure chambers.

Positive voltage +V is applied to the terminals 37*a*-37*e*; alternatively, the terminals are grounded. In the state ST1, the positive voltage +V is evenly applied to the terminals 37*a*-37*e*. This state moves to the state ST2 at the time t1. In the state ST2, the terminal 37*a* is grounded, and the other terminals still have the positive voltage +V applied as the above.

Here, the electrode connected to the terminal 37*a* is at zero potential and the corresponding pressure chamber 31*a* expands as illustrated in FIG. 5 when the terminal 37*a* receives a negative voltage. On the other hand, the adjacent pressure chambers 31*b* and 31*d* become concave on the respective sides facing the pressure chamber 31*a*.

At the time t2 after elapse of AL from the time t1, the state moves to the state ST3. The positive voltage +V is applied to the terminal 37*a*, and the other terminals are grounded. Here, the period from the time t1 to the time t2 is referred to as a first AL period.

In the state ST3, the positive voltage +V is applied to the electrode connected to the terminal 3*a*. As illustrated in FIG. 6, the corresponding pressure chamber 31*a* becomes concave, and an ink droplet is ejected, from the nozzle 33*a*. The adjacent pressure chambers 31*b* and 31*d* expand on the respective sides of the pressure chamber 31*a*.

At the time t3 after elapse of time T1 and time t2, the state is returned to the state ST1 as illustrated in FIG. 4, where the positive voltage +V is applied to each terminal. In this state, each pressure chamber is returned to the normal state.

At the time t4 after elapse of time T2 front the time t3, the state becomes the state ST3 again. In other words, the positive voltage +V is applied to the terminal 37*a*, and the pressure chamber 31*a* corresponding to the nozzle 33*a* becomes concave. The adjacent pressure chambers 31*b* and 31*d* expand on the respective sides of the pressure chamber 31*a*. The period from the time t2 to the time t4 is referred to as a second AL period.

Then, at the time t5 after elapse of a third AL period from the time t4, the state becomes the state ST1 as illustrated in FIG. 4. The period from, the time t4 to the time t5 is referred to as the third AL period.

At the time to after the period AL/2, the state becomes the state ST2 as illustrated in FIG. 5. In this state, the terminal 37*a* is grounded, the other terminals have the positive voltage +V applied and the pressure chamber 31*a* expands. The period from the time t5 to the time t7 is referred to as a fourth AL period.

At the time t7 after the period AL/2, the state is returned to the state ST1 as illustrated in FIG. 4 and this state continues to the time t8. This period is referred to as a fifth AL period.

As mentioned above, the total period of the driving signal is five times the period AL, after which the driving signal is repeated. The pressure chamber 31*a* repeatedly expands and contracts through-selection of the positive voltage +V or grounding between the terminal 37*a* and the other terminals. According to the applied driving signal, ink droplets are ejected from the corresponding nozzle 33*a*.

Here, the sum of the above times T1 and T2 is the period AL. The time T1 and the time T2 will now be described.

Although it depends on the characteristics of ink viscosity, when the time T1 is short, generally, the ejected ink droplet is small and the droplet speed of the ink becomes slow, which is not preferable as the printing characteristics. Therefore, generally, it is preferable that the time T1 is longer than the time 2, or T1>AL/2>T2.

Figure 7:
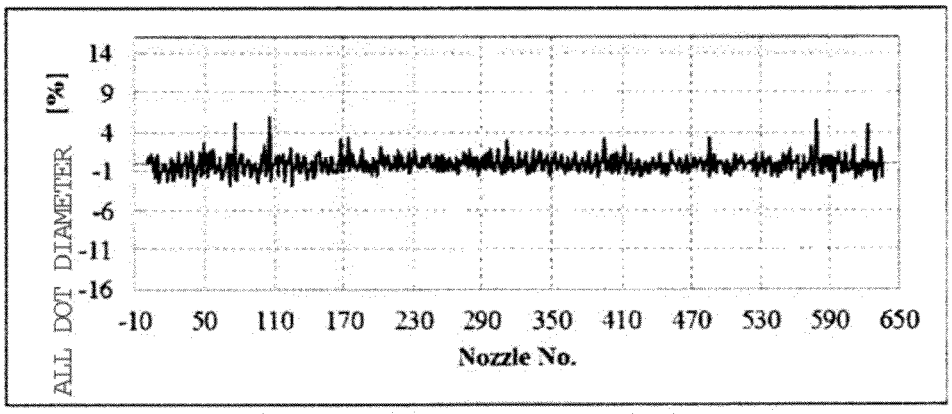
FIG. 7 illustrates diameters of each ink droplet ejected from respective nozzles in a conventional inkjet head.
Figure 8:
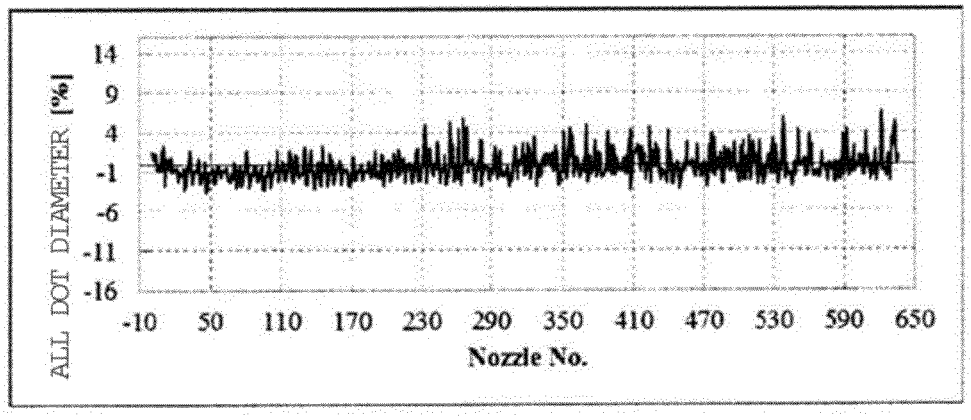
FIG. 8 illustrates diameters of each ink droplet ejected from respective nozzles in the inkjet head according to the embodiment.

Next, the performance will be described when the above-described driving waveform is applied from the driving signal generating unit to the electrode of the pressure chamber. A comparison of the ink diameter is illustrated in FIGS. 7 and 8, between the case where the respective pressure chambers are driven with the conventional driving waveform, example 2, and the case where they are driven with the driving waveform according to the above-described embodiment. A comparison of linearity of the ink droplets is indicated in FIGS. 9 and 10.

Figure 9:
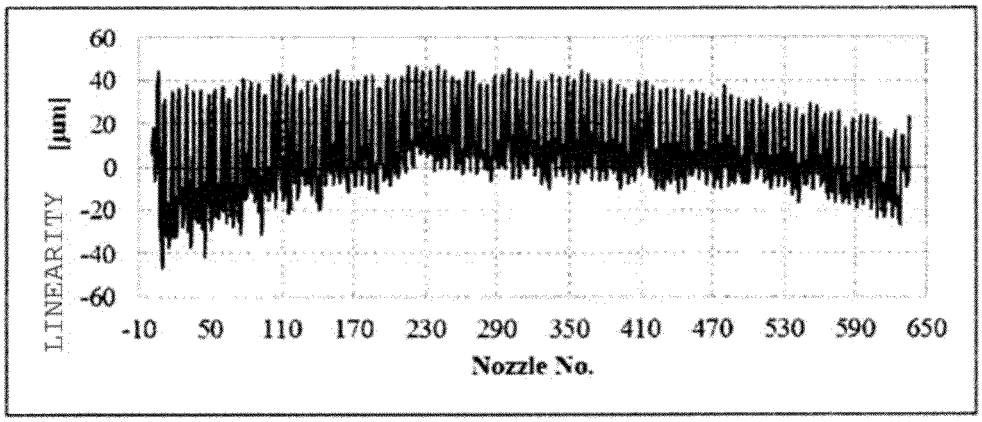
FIG. 9 illustrates linearity of each ink droplet ejected from the respective nozzles in the conventional inkjet head.
Figure 10:
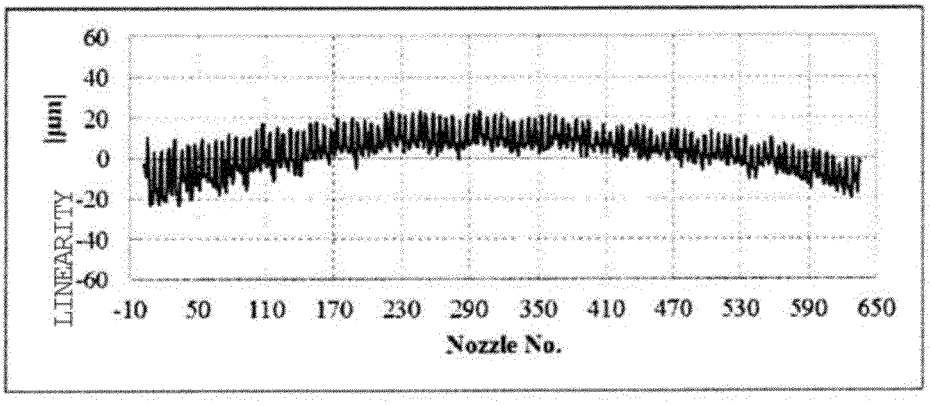
FIG. 10 illustrates linearity of each ink droplet ejected from the respective nozzles in the inkjet head according to the embodiment.
Figure 11:
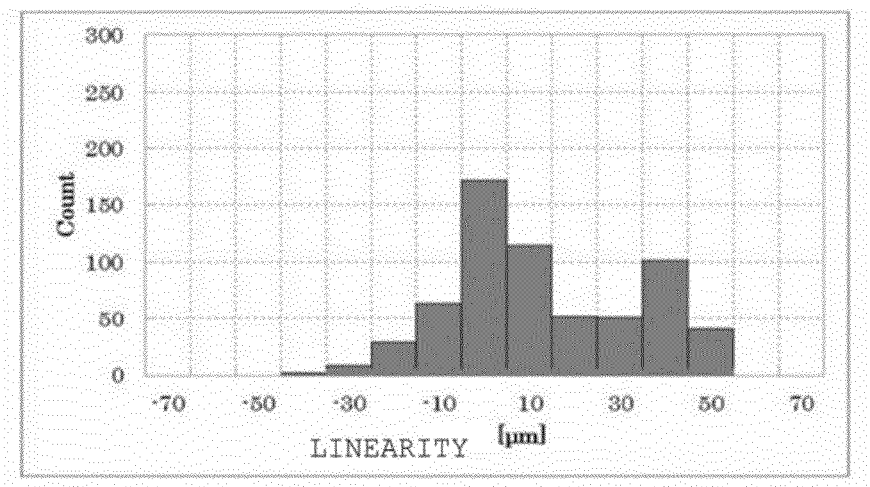
FIG. 11 illustrates a histogram of each ink droplet ejected from the respective nozzles in the conventional inkjet head.
Figure 12:
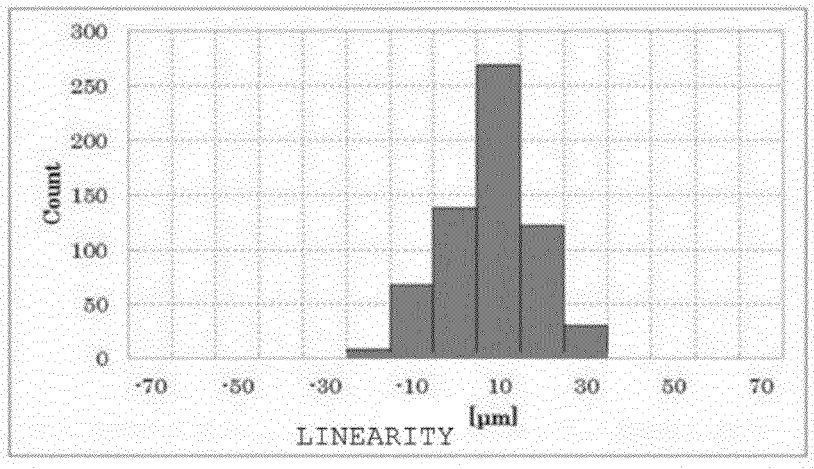
FIG. 12 illustrates a histogram of each ink droplet ejected from the respective nozzles in the inkjet head according to the embodiment.

In FIGS. 9 and 10, a horizontal axis indicates the nozzle number of each aligned nozzle and a vertical axis indicates linearity (μm) of the ink droplets. According to a comparison between the characteristic diagrams, a fluctuation in the ink droplets is smaller in the case of the above-described embodiment than in the conventional case. Accordingly, the above-described embodiment results in a better linearity. Further, a histogram of the linearity of ink droplets of the conventional case and the above-described embodiment is illustrated in FIGS. 11 and 12, respectively.

Figure 13:
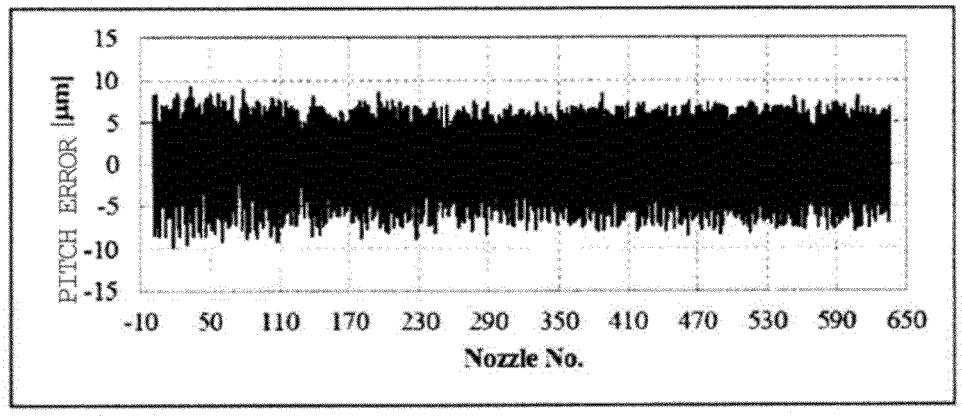
FIG. 13 illustrates characteristics of pitch error of each ink droplet ejected from the respective nozzles in the conventional inkjet head.
Figure 14:
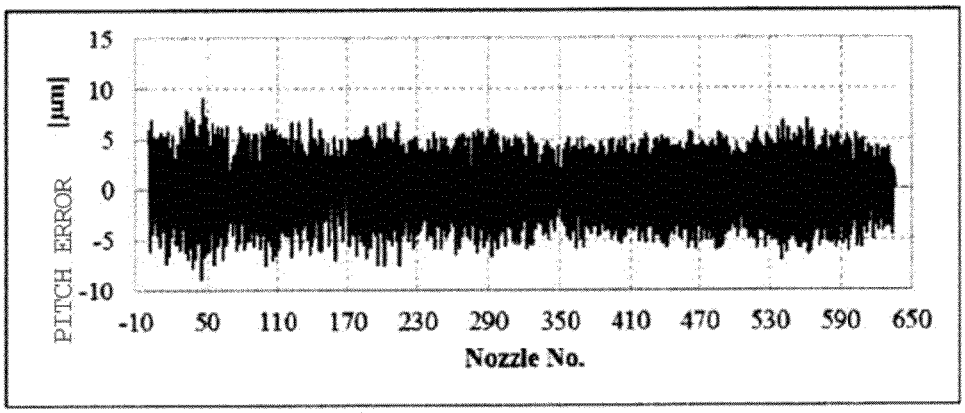
FIG. 14 illustrates pitch error of each ink droplet ejected from the respective nozzles in the inkjet head according to the embodiment.

Further, a comparison of pitch error is illustrated in FIGS. 13 and 14 between the case of driving the respective pressure chambers with the conventional driving waveform and the case of driving them with the driving waveform according to the above-described embodiment.

Figure 15:
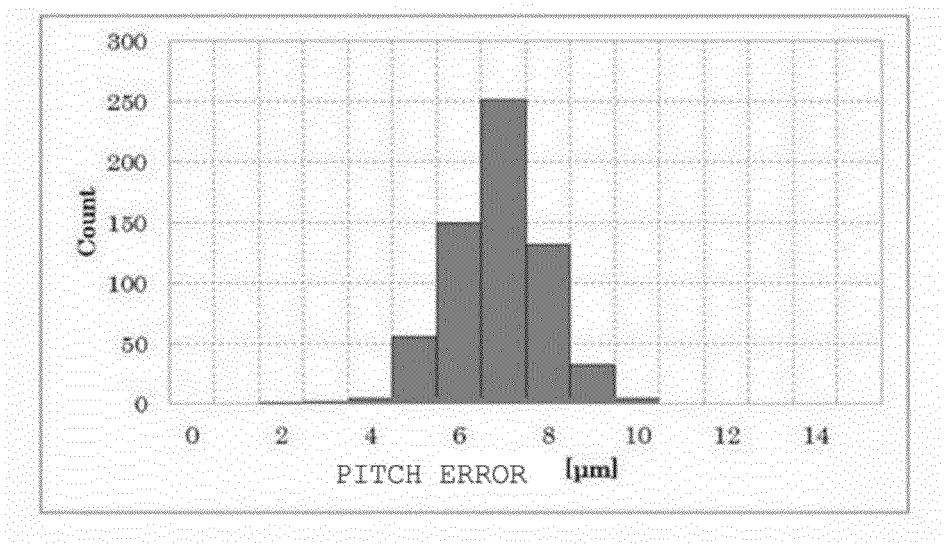
FIG. 15 illustrating a histogram of pitch error of each ink droplet ejected from the respective nozzles in the conventional inkjet head.
Figure 16:
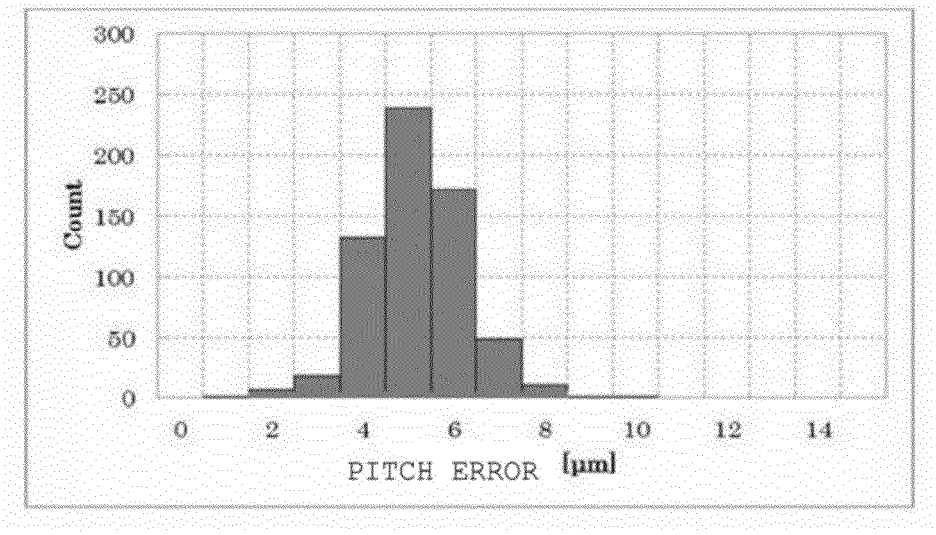
FIG. 16 illustrates a histogram of pitch error of each ink droplet ejected from the respective nozzles in the inkjet head according to the embodiment.

In FIGS. 13 and 14, a horizontal axis indicates the nozzle number of each aligned nozzle and a vertical axis indicates the pitch error (μm) of the ink. Using histogram, FIGS. 15 and 16 show a comparison of the pitch error. According to a comparison between the characteristic diagrams, it can be seen that the pitch error is smaller in the case of the above-described embodiment than in the conventional case. Thus, the above-described embodiment may put an ink droplet accurately at a predetermined position.

According to the above data, the ejection amount of ink may be increased and printing may be accurately performed in the above-described embodiment.

According to the embodiment, an inkjet head capable of stably ejecting a sufficient amount of ink may be obtained.

In the above embodiment, the state in which a predetermined positive voltage +V is applied to all the electrodes connected to the piezoelectric members of the pressure chambers, is defined as a reference (ST1). By transitioning from the state (ST2) in which the electrode connected to a particular piezoelectric member of a pressure chamber is grounded and the other electrodes have the positive voltage +V, to the state (ST3) in which the positive voltage +V is applied to the electrode connected to the particular piezoelectric member and the other electrodes are grounded, ink droplets are ejected. These states, however, are relative. A pressure may be applied to the pressure chambers in the same way, and the state (ST1) of applying a predetermined positive voltage +V to every electrode does not have to be made as a reference. The positive voltage +V and a negative voltage −V do not have to be identical as the absolute value.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a plurality of pressure chambers, each in communication with an ink supply;

a plurality of piezoelectric members configured to deform to vary the volume of the pressure chambers; and a drive unit configured to apply a driving signal to each of the piezoelectric members, wherein the driving signal includes, in order:

a first negative voltage over a first period having a predetermined length, a first positive voltage followed by a zero voltage over a second period having the predetermined length, a second positive voltage over a third period having the predetermined length, the zero voltage followed by a second negative voltage over a fourth period having the predetermined length, and the zero voltage over a fifth period having the predetermined length, where the predetermined length is a half of an inherent vibration cycle of ink that is within the pressure chamber.

2. The inkjet head according to claim 1, wherein, during the second period:

the first positive voltage is applied over a time T1, the zero voltage is applied over a time T2, and the time T1 is longer than the time T2.

3. The inkjet head according to claim 1, wherein, when a negative voltage of the driving signal is applied to a particular piezoelectric member, the particular piezoelectric member is grounded and a positive voltage is applied to other piezoelectric members.

4. The inkjet head according to claim 1, wherein, when a positive voltage of the driving signal is applied to a particular piezoelectric member, other piezoelectric members are grounded.

5. The inkjet head according to claim 1, wherein:

when a negative voltage of the driving signal is applied to a particular piezoelectric member, the particular piezoelectric member is grounded and a positive voltage is applied to other piezoelectric members, and when a positive voltage of the driving signal is applied to a particular piezoelectric member, other piezoelectric members are grounded.

6. The inkjet head according to claim 1, wherein the total period of the driving signal is five times the predetermined length.

7. The inkjet head according to claim 1, further comprising:

a vibration plate, wherein expansion and contraction of the piezoelectric member in response to the driving signal vibrates the vibration plate and causes a pressure wave through the ink in the pressure chamber.

8. A driving device for driving an inkjet head that includes a plurality of pressure chambers in communication with an ink supply and a plurality of piezoelectric members configured to deform to vary the volume of the pressure chambers, the driving device comprising:

a communication device configured to receive print data;

a processor configured to calculate a driving signal based on the print data; and a drive unit configured to generate and supply the driving signal to each of the piezoelectric members, wherein the driving signal includes, in order:

a first negative voltage over a first period having a predetermined length, a first positive voltage followed by a zero voltage over a second period having the predetermined length, a second positive voltage over a third period having the predetermined length, the zero voltage followed by a second negative voltage over a fourth period having the predetermined length, and the zero voltage over a fifth period having the predetermined length, where the predetermined length is a half of an inherent vibration cycle of ink that is within the pressure chamber.

9. The driving device according to claim 8, wherein, during the second period:

the first positive voltage is applied over a time T1, the zero voltage is applied over a time T2, and the time T1 is longer than the time T2.

10. The driving device according to claim 8, wherein, when a negative voltage of the driving signal is applied to a particular piezoelectric member, the particular piezoelectric member is grounded and a positive voltage is applied to other piezoelectric members.

11. The driving device according to claim 8, wherein, when a positive voltage of the driving signal is applied to a particular piezoelectric member, other piezoelectric members are grounded.

12. The driving device according to claim 8, wherein:

when a negative voltage of the driving signal is applied to a particular piezoelectric member, the particular piezoelectric member is grounded and a positive voltage is applied to other piezoelectric members, and when a positive voltage of the driving signal is applied to a particular piezoelectric member, other piezoelectric members are grounded.

13. The driving device according to claim 8, wherein the total period of the driving signal is five times the predetermined length.

14. The driving device according to claim 8, wherein expansion and contraction of the piezoelectric member in response to the driving signal vibrates a vibration plate and causes a pressure wave through the ink in the pressure chamber.

15. A method of driving an inkjet head that includes a plurality of pressure chambers in communication with an ink supply and a plurality of piezoelectric members configured to deform to vary the volume of the pressure chambers, the method comprising the steps of:

receiving print data;

calculating a driving signal based on the print data; and applying a driving signal to each of the piezoelectric members, wherein the driving signal includes, in order:

a first negative voltage over a first period having a predetermined length, a first positive voltage followed by a zero voltage over a second period having the predetermined length, a second positive voltage over a third period having the predetermined length, the zero voltage followed by a second negative voltage over a fourth period having the predetermined length, and the zero voltage over a fifth period having the predetermined length, where the predetermined length is a half of an inherent vibration cycle of ink that is within the pressure chamber.

16. The method according to claim 15, wherein, during the second period:

the first positive voltage is applied over a time T1, the zero voltage is applied over a time T2, and the time T1 is longer than the time T2.

17. The method according to claim 15, wherein, when a negative voltage of the driving signal is applied to a particular piezoelectric member, the particular piezoelectric member is grounded and a positive voltage is applied to other piezoelectric members.

18. The method according to claim 15, wherein, when a positive voltage of the driving signal is applied to a particular piezoelectric member, other piezoelectric members are grounded.

19. The method according to claim 15, wherein:

when a negative voltage of the driving signal is applied to a particular piezoelectric member, the particular piezoelectric member is grounded and a positive voltage is applied to other piezoelectric members, and when a positive voltage of the driving signal is applied to a particular piezoelectric member, other piezoelectric members are grounded.

20. The method according to claim 15, wherein the total period of the driving signal is five times the predetermined length.

* * * * *